US005081501A

United States Patent [19]

Waki et al.

[11] Patent Number: 5,081,501

[45] Date of Patent: Jan. 14, 1992

[54] IMAGE FORMING APPARATUS HAVING TRANSFER ELECTRODE

[75] Inventors: Kenichiro Waki, Kawasaki; Takeo Tsunemi; Akira Watanabe, both of Yokohama, all of Japan

[73] Assignee: Canon Kabushiki Kaisha, Tokyo, Japan

[21] Appl. No.: 707,082

[22] Filed: May 29, 1991

[30] Foreign Application Priority Data

May 31, 1990 [JP] Japan ..... 2-142837

[51] Int. Cl.[5] ..... G03G 15/16; G03G 15/14

[52] U.S. Cl. ..... 355/274; 355/271; 355/273; 355/277; 430/126

[58] Field of Search ..... 355/271, 272, 274, 277, 355/219, 273, 275, 327; 361/225, 230; 430/48, 126

[56] References Cited

U.S. PATENT DOCUMENTS 4,571,052 2/1986 Shirai ..... 355/274

4,864,367 9/1989 Nakahara et al. ..... 355/274 X 4,875,069 10/1989 Takeda et al. ..... 355/271

*Primary Examiner*—A. T. Grimley

*Assistant Examiner*—Matthew S. Smith

*Attorney, Agent, or Firm*—Fitzpatrick, Cella, Harper & Scinto

[57] ABSTRACT

The present invention provides an image forming apparatus having a shiftable image bearing member; an image forming device for forming an image on the image bearing member; and a transfer device for transferring the image formed on the image bearing member onto a transfer sheet at a transfer station, the transfer device urging the transfer sheet against the image bearing member and having a transfer electrode to which a voltage is applied; and wherein a resistance value between a surface of the transfer electrode facing the image bearing member and a portion of the transfer electrode at which the voltage is applied is greater at an upstream side of a shifting direction of the image bearing member than at a downstream side thereof, on the surface of the transfer electrode, whereby an image can be obtained without any transfer void.

9 Claims, 5 Drawing Sheets

IMAGE FORMING APPARATUS HAVING TRANSFER ELECTRODE

BACKGROUND OF THE INVENTION

1. Field of the Invention

The present invention generally relates to an image forming apparatus, and, more particularly, it relates to an image forming apparatus wherein an image is obtained by electrostatically transferring an image electrophotographically or electrostatically formed on an image bearing member onto a transfer sheet. Such image forming apparatus is embodied as a mono-color or full-color electrophotograhic copying machine, printer or other various recording equipments.

2. Related Background Art

In the past, in an image forming apparatus such as an electrophotographic copying machine, it has been known that a toner image formed on a photosensitive drum acting as an image bearing member is transferred onto a transfer sheet at a transfer station by means of a transfer corona discharger comprising a discharging wire and a shield electrode. Further, in a full-color image forming apparatus, it has been known that a plurality of color toner images formed on the photosensitive drum are successively transferred onto a transfer sheet held on a transfer drum in a superimposed fashion by means of a transfer corona discharger.

However, as seen in the above-mentioned conventional electrophotographic copying machine, since the corona discharger was used to transfer the toner image formed on the photosensitive drum on the transfer sheet, the following problem arose.

That is to say, it is necessary to normally apply a high voltage of 6–8 KV to the discharging wire of the corona discharger, and only a portion of a corona current flows toward the photosensitive drum and others flow toward the shield electrode which is earthed. Thus, it is necessary to provide a transfer corona current greater than a current which actually contributes to the transfer operation.

Accordingly, a power source having greater voltage capacity and current capacity is required, and, insulators for the wiring must have greater pressure-resistance feature, thus making the apparatus large-sized and expensive. Further, since the corona discharger is used, the generated corona discharge creates ozone which, in tern, generates the image flow affecting a bad influence upon the photosensitive drum.

In order to solve the above problem, a method wherein, in place of the transfer corona discharger, an electrode is contacted with a back surface of a transfer sheet bearing member, i.e., dielectric sheet 93 of the transfer drum 9 to apply the voltage as shown in FIG. 10 has been proposed. According to this method, an elastic synthetic resin film 20 supported by a support 19 made of rigid material such as metal is disposed within the transfer drum 9 at a transfer station where the transfer drum 9 contacts with a photosensitive drum 3, and, further, a conductive metal sheet 21 acting as a transfer electrode is arranged on a free end of the synthetic resin film 20 and is connected to an electric power source.

Although this method could provide a simple and inexpensive device which did not generate the ozone during the transfer operation, it arose another problem. That is to say, if a paper left under a low humidity (10 %RH) condition was used as the transfer sheet, the transfer void would occur. As a result of consideration regarding this problem, the inventor has found that the transfer void occurs because the transfer electric field is generated before the photosensitive drum is contacted with the transfer sheet, thereby occurring the discharge phenomenon so that the toner is charged to a polarity opposite to a polarity charged in the developing operation. Further, this conventional method arose a problem that the toner is scattered around a portion on which an image such as a character and the like is formed later, by means of the transfer electric field generated before the contact between the photosensitive drum and the transfer sheet.

SUMMARY OF THE INVENTION

The present invention aims to solve the abovementioned conventional problems, and an object of the present invention is to provide an image forming apparatus which can reduce the scattering of the toner and prevent the transfer void.

Another object of the present invention is to provide an image forming apparatus which can obtain an image having high image density with high quality regardless of circumstances.

A further object of the present invention is to provide an image forming apparatus which is simple and inexpensive and which can prevent the generation of ozone.

Other objects and features of the present invention will be apparent from the following description referring to the accompanying drawings.

DETAILED DESCRIPTION OF THE PREFERRED EMBODIMENTS

The present invention will now be explained in connection with embodiments with reference to the accompanying drawings.

Figure 2:
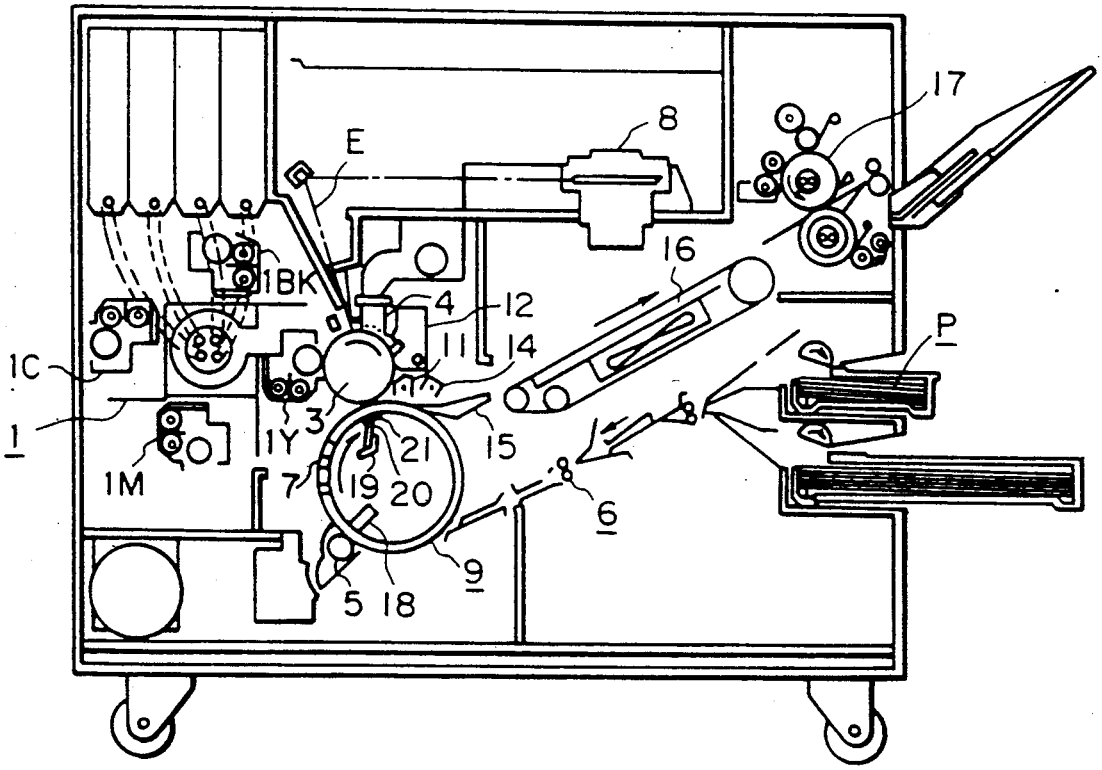
FIG. 2 is a schematic elevational sectional view of the image forming apparatus of the present invention.

FIG. 2 shows an image forming apparatus to the present invention, embodied as a full-color electrophotographic copying machine. The full-color electrophotographic copying machine comprises an image bearing member (photosensitive drum) 3 rotatably supported on a shaft (not shown) and rotated in a direction shown by the arrow, and an image forming means disposed around the photosensitive drum. Although the image forming means may be appropriately constructed, in this embodiment, it comprises a primary charger 4 for uniformly charging the photosensitive drum 3, an exposure means 8 (for example, comprised of a laser beam exposure device) for illuminating color-separated light images or other similar light images onto the photosensitive drum to form an electrostatic latent image on the photosensitive drum 3, and a rotary developing system 1 for visualizing the electrostatic latent image formed on the photosensitive drum 3.

The rotary developing system 1 comprises four developing devices 1Y, 1M, 1C and 1BK containing therein yellow developer, magenta developer, cyan developer and black developer, respectively, and a substantially cylindrical housing holding these four developing devices and rotatably supported. The rotary developing system 1 is so constructed that it conveys a desired developing device to be positioned in confronting relation to a peripheral surface of the photosensitive drum 3 by the rotation for the housing, and develops the electrostatic latent image formed on the photosensitive drum 3 to obtain a four-color image.

Figure 9:
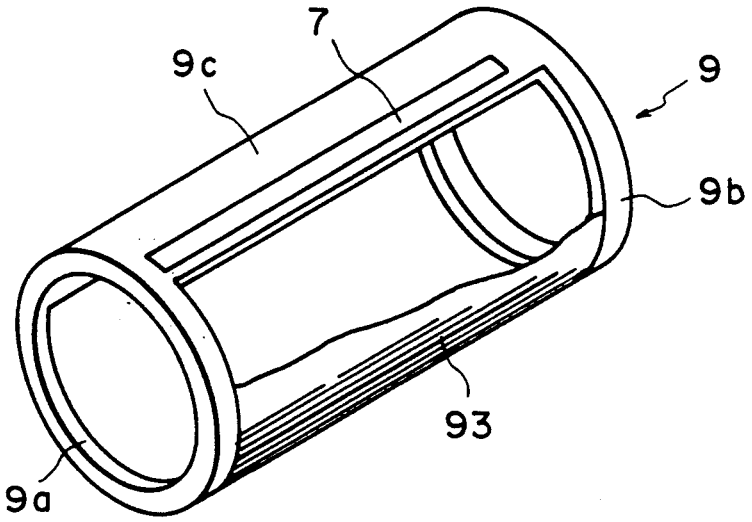
FIG. 9 is a perspective view of a transfer drum adaptable to the present invention.
Figure 10:
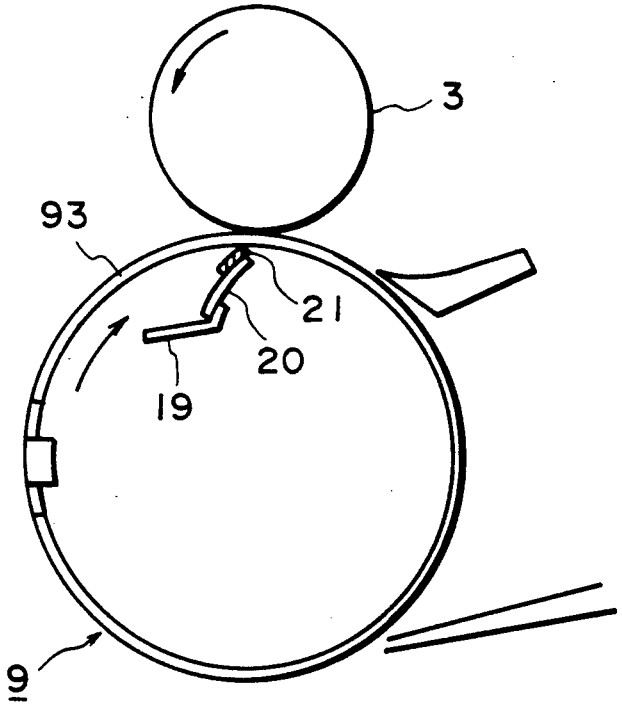
FIG. 10 is a schematic sectional view of a conventional transfer means.

The visualized image (toner image) on the photosensitive drum 3 is transferred onto a transfer sheet P carried and conveyed by a transfer device 9. In the illustrated embodiment, the transfer device 9 comprises a rotatable transfer drum which has cylinders *9a*, *9b* disposed at its both ends, and a connection member *9c* connecting these cylinders, as clearly shown in FIG. 9. A transfer sheet bearing member 93 is arranged to close or cover an peripheral opening between the cylinders *9a*, *9b*. The transfer sheet bearing member 93 normally comprises a film-shaped dielectric sheet made of, for example, polyethylene terephthalate film or polyvinylidene fluoride resin film. Further, the connection member *9c* has a transfer sheet gripper 7 for gripping the transfer sheet fed from a sheet supplying device.

Returning to FIGS. 1 and 2, at a transfer station where the transfer drum 9 contacts with the photosensitive drum 3, a transfer means for generating a transfer electric field is disposed within the transfer drum 9, which transfer means comprises a transfer electrode 21 contacting with an inner surface of the transfer drum. Further, outer charge removing dischargers 11, 14 are disposed around the transfer drum at a downstream side of the transfer drum with respect to a rotational direction of the transfer drum.

Next, a process for forming a full-color image by means of the full-color electrophotographic copying machine will be described briefly.

The photosensitive drum 3 is uniformly charged by the primary charger 4, and then, the electrostatic latent image is formed on the photosensitive drum 3 by illuminating the light image corresponding to image information by means of the exposure means 8. The electrostatic latent image is visualized as the toner image by applying resin-based toner having an average particle diameter of 12 μm to the photosensitive drum 3 by means of the rotary developing system 1.

On the other hand, the transfer sheet P is fed to the transfer drum 9 in synchronous with the toner image by means of regist rollers 6 and is held at its leading end by the gripper 7. The transfer sheet is conveyed by the transfer drum in the direction shown by the arrow in FIG. 2.

Then, at the transfer station where the photosensitive drum 3 contacts with the transfer drum 9, the toner image formed on the photosensitive drum 3 is transferred onto the transfer sheet P by applying a voltage having a polarity opposite to that of the toner to the transfer electrode positioned on the back surface of the transfer sheet bearing member (dielectric sheet) 93.

After a required number of transfer processes corresponding to the number of images formed on the photosensitive drum 3 are repeated to superimpose the toner images, the charge is removed from the transfer sheet P by the dischargers 11, 14, and the transfer sheet is separated from the transfer drum 9 by means of a separating pawl or claw 15, and then is fed to a fixing device 17 by means of a conveying belt 16. Thereafter, the transfer sheet P is heated by the fixing device 17 so that the superimposed toner images are fixed onto the transfer sheet to form a color image, and then is ejected out of the apparatus.

On the other hand, residual toner remaining on the photosensitive drum 3 is removed by a cleaning device 12, and the cleaned photosensitive drum is reused to form a new image thereon. Further, a surface of the dielectric sheet 93 of the transfer drum 9 is also cleaned by a cleaning device 5 comprised of a furbrush and a back-up auxiliary cleaning means 18 and is reused for a new image forming process.

Figure 1:
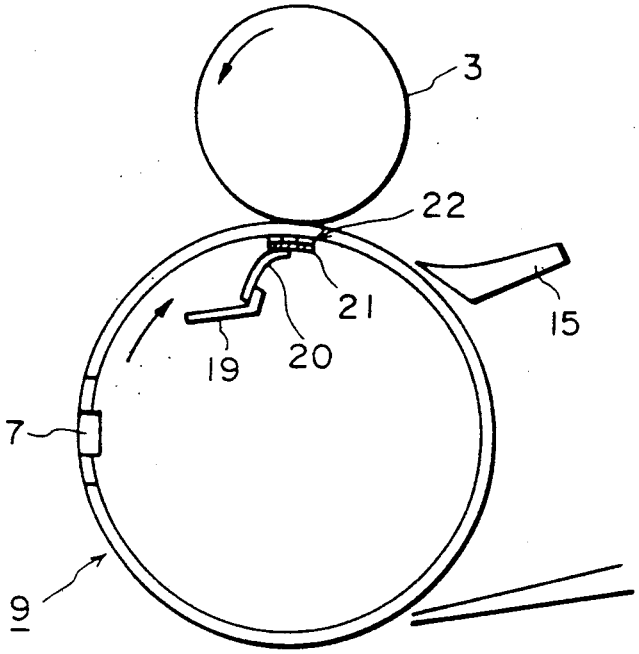
FIG. 1 is a schematic sectional view showing a main portion of an image forming apparatus according to a preferred embodiment of the present invention.
Figure 3:
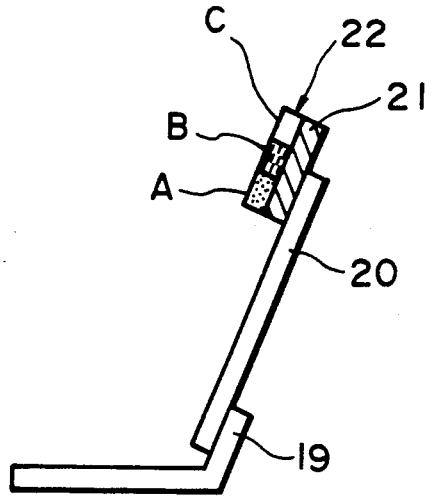
FIG. 3 is an elevational view of an embodiment of a transfer means associated with the present invention.
Figure 4:
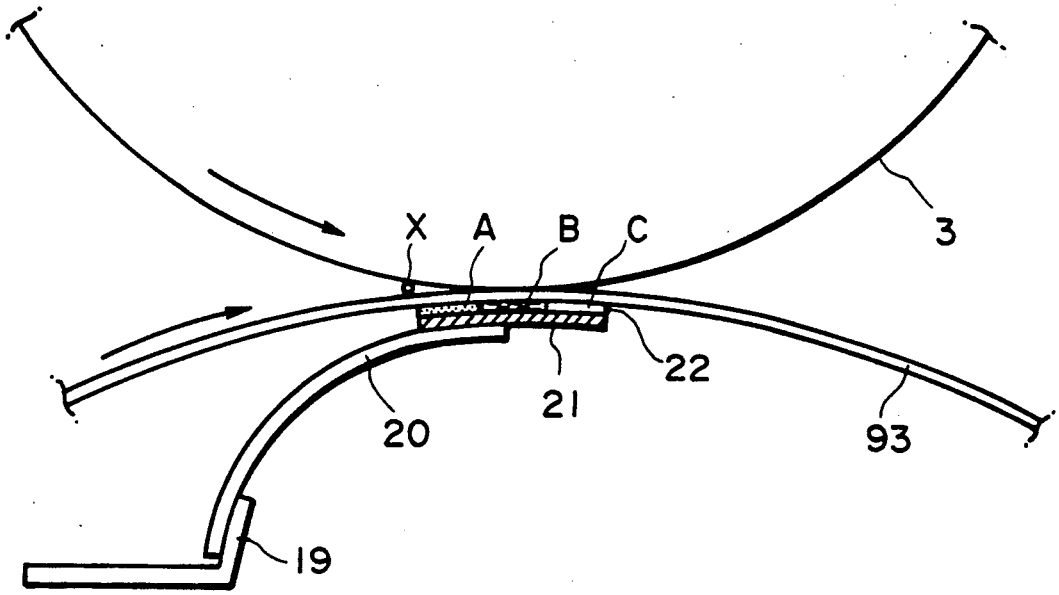
FIG. 4 is an enlarged sectional view for explaining an operation of the transfer means of the image forming apparatus of the present invention.

With reference to FIGS. 1, 3 and 4, the transfer means comprises an elastic synthetic resin film (elastic sheet made of polyethylene terephthalate (PET)) 20 disposed on a support 19 made of rigid material such as metal, and a conductive metal sheet 21 attached to a free end of the film 20. Further, a resistive sheet 22 is attached to a surface of the conductive metal sheet 21.

Now, the resistive sheet 22 will be explained with reference to FIG. 3.

In the illustrated embodiment, the resistive sheet 22 has a thickness of 100 μm and is constituted by three resistive sheets A, B and C. The resistive sheet 22 has a resistance value controlled by mixing or dispersing carbon and the like into the synthetic resin or rubber, so that the volume resistivities of the sheets A, B and C become $10^{11}$Ωcm, $10^{8}$ Ωcm and $10^{6}$ Ωcm, respectively. The measurement of the volume resistivity was effected by using the material known as "4329A" (registered trade mark) manufactured by YHP Company and by applying a voltage of 1 KV to it. The volume resistivity of the conductive metal sheet 21 is preferably $10^{3}$ Ωcm or less, and, among the resistances between the voltage applying portion and the surface of the resistive sheet 22 facing the photosensitive drum 3, the resistance of the conductive metal sheet 21 is so selected that it can be neglected with respect to the resistance of the resistive sheet 22.

The arrangement of the transfer means comprising the support 19, elastic sheet 20, conductive metal sheet 21 and resistive sheet 22 is preferably selected so that the elastic sheet 20, metal sheet 21 and resistive sheet 22 extend from an introduction side of the dielectric sheet 93 acting as the transfer sheet bearing member toward a downstream side of the moving direction of the dielectric sheet, and the resistive sheet 22 is pressured against the dielectric sheet 93 at or near a position where the transfer sheet P starts or finishes to contact with the photosensitive drum 3. That is to say, by such press, the toner image formed on the photosensitive drum 9 is contacted with the transfer sheet held by the dielectric sheet 93. Further, as shown in FIG. 4, a width of a nip between the resistive sheet and the dielectric sheet is so selected as to become greater than a width of a nip between the photosensitive drum and the dielectric sheet.

FIG. 4 shows a transfer portion with an enlarged scale. During the transferring operation, the voltage is applied to the conductive metal sheet 21 to transfer the toner image on the photosensitive drum 3 onto the transfer sheet (not shown in FIG. 4) held on the dielectric sheet 93. That is to say, the transfer electrode has the conductive metal sheet 21 and the resistive sheet 22, and, by applying the voltage to the transfer electrode, the electric charges are supplied to the dielectric sheet 93 from the conductive metal sheet 21 through the resistive sheet 22. In this case, since the resistive sheet 22 has the above-mentioned resistance distribution, the electric charges supplied to the dielectric sheet 93 is smallest at the portion A with respect to the other portions B and C. That is to say, since the electric resistance value from the surface of the resistive sheet 22 constituting the transfer electrode surface facing the photosensitive drum 3 to the conductive metal sheet 21 to which the transfer voltage is applied is higher at the upstream side of the photosensitive drum 3 than at the downstream side thereof on the surface of the resistive sheet 22, the electric field generated at the upstream side (i.e., portion X shown in FIG. 4) of the nip between the dielectric sheet 93 and the photosensitive drum 3 becomes weaker than those generated at other portions.

With the image forming apparatus according to the illustrated embodiment, the inventors obtained the toner image by forming the latent image on the photosensitive drum 3 charged with negative polarity and by reversely developing the latent image with the toner having an average particle diameter of about 8–10 μm. In this case, the toner was constituted by resin, dye, and a smaller amount of additive for improving the charge control feature and lubricity, and was charged with negative polarity by frictionally contacting with carrier particles in the developing system. As mentioned above, thereafter, the toner image was transferred onto the transfer sheet by using the above-mentioned transfer device. Then, the transfer sheet was separated from the transfer drum 9 and then was fixed by the fixing device 17.

A polyvinylidene fluoride sheet having a thickness of 150 μm was used as the dielectric sheet 93. In this embodiment, a diameter of the transfer drum was 160 mm, and a rotating speed of the transfer drum was set to have a value of 160 mm/sec. Similarly, the process speed such as a rotating speed of the photosensitive drum 3 was also set to have a value of 160 mm/sec.

Under the low humidity (10 %RH) condition, when the image was transferred onto a low humidity paper as the transfer sheet, the image having high image density could be obtained without any transfer void. According to the present invention, it is considered that such image is obtained for the reason that the image distortion due to the discharging does not occur at the upstream side of the transfer nip (between the photosensitive drum and the dielectric sheet) because the electric field is not so strong as to generate such discharging and that the electric field sufficient to effect the image transfer can be established at the transfer nip and at the downstream side thereof.

Figure 5:
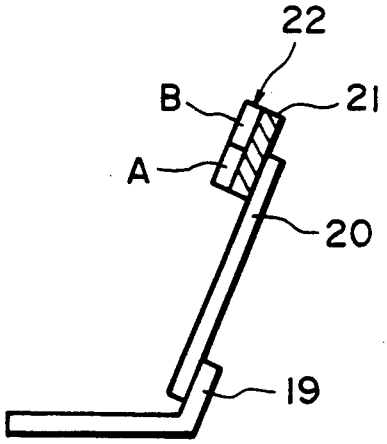
FIG. 5 is an elevational view of a transfer means according to another embodiment.
Figure 6:
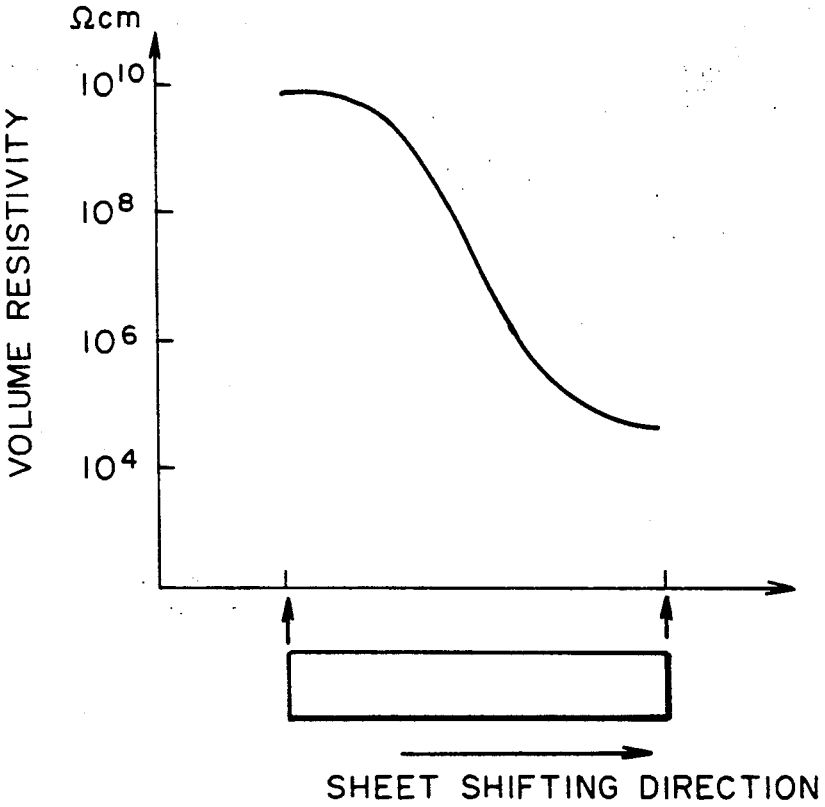
FIG. 6 is a graph showing the change in volume resistivity of a resistive sheet of a transfer means according to a further embodiment.

In the above-mentioned embodiment, as shown in FIG. 3, while an example that the resistive sheet 22 is constituted by three sheets A, B, C was explained, the resistive sheet may be constituted by two sheets, i.e., a resistive sheet A having the volume resistivity of $10^8$ Ωcm and a resistive sheet B having the volume resistivity of $10^5$ Ωcm, as shown in FIG. 5. Alternately, the resistive sheet 22 may be constituted so that the volume resistivity thereof is continuously varied as shown in FIG. 6 by devising or adjusting the distribution of the carbon in the resin or rubber. With this arrangement, for example, the versatility for urging the transfer electrode against the dielectric sheet is improved, thereby facilitating the design of the electrode.

As mentioned above, since the resistance value between the voltage applying portion of the transfer electrode and the surface of the transfer electrode is greater at the upstream side of the rotating direction of the dielectric sheet 93 than at the downstream side thereof, it is possible to obtain the image with high quality and with high transfer ability, without any transfer void.

According to the present invention, the bias voltage applied to the metal sheet 21 to generate the transfer electric field can be merely in the order of +0.7–1.5 KV, which is considerably smaller than the voltage (6–8 KV) required to transfer the image by the corona current using the conventional transfer discharger and which can achieve the same transfer efficiency as that by the corona current.

Further, when the transfer corona discharger is used, there exists the current which does not directly contribute to the transfer operation and flows toward the shield. To the contrary, according to the transfer means of the present invention, such current does not exist. Therefore, according to the present invention, the electric power source having smaller voltage and current capacities can be used, and, the insulator having smaller dielectric strength can be used for the wiring, thus making the apparatus small-sized and inexpensive.

Furthermore, as a result of the tests using the dielectric sheets 93 having various volume resistivities, it was found that, by utilizing the dielectric sheet 93 having the volume resistivity of $10^8$Ωcm–$10^{16}$Ωcm, preferably, $10^9$Ωcm–$10^{12}$Ωcm, the deterioration of the image quality due to the discharge generated in separating of the transfer sheet P from the dielectric sheet 93, or the discrepancy and/or unevenness in color due to the poor attraction force between the dielectric sheet 93 and the transfer sheet P did not occur, and the image having the adequate transfer efficiency could be obtained.

Further, when the dielectric sheet 93 having the volume resistivity of $10^{12}$ Ωcm or less was used, it was found that, since the potential attenuation was quickly attained after the charging due to the transfer, the deterioration of the transfer efficiency in the multi-transfer of images with 2nd–4th colors or in the continuous copying operation did not exist or was negligible. Accordingly, it is not need to use the corona dischargers for removing the chargers, thus making the apparatus more compact and inexpensive, and it is possible to prevent the generation of ozone.

Further, even when the dielectric sheet 93 having the relatively great volume resistivity such as $10^{16}$ Ωcm was used, by using such dielectric sheet having the specific dielectric constant of 4 or more, it was found that the effective transfer efficiency could be obtained by utilizing the bias voltage of 1.0–1.5 KV which is considerably smaller than the voltage (6–8 KV) required to transfer the image by the corona current using the conventional transfer discharger.

Figure 7:
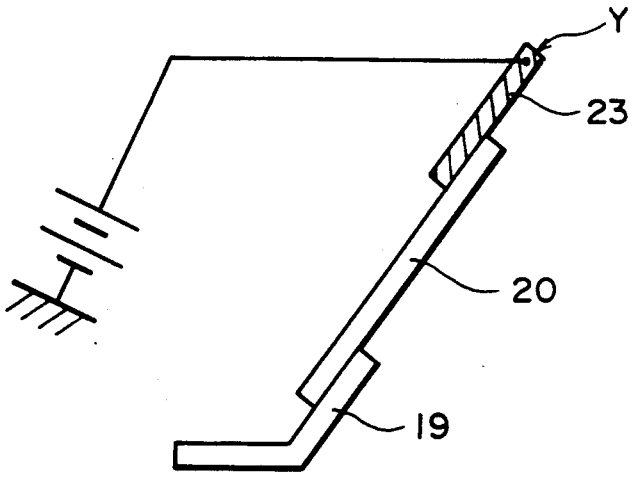
FIG. 7 is an elevational view of a transfer means according to a still further embodiment.

FIG. 7 shows a further embodiment of the transfer means associated with the present invention. In this embodiment, the transfer means comprises an elastic sheet 20 made of polyethylene terephthalate (RET) and disposed on a support 19 made of rigid material such as metal, similar to the former embodiments. However, in this embodiment, a transfer electrode 23 made of resistive material is attached to the free end of the elastic sheet 20. Incidentally, the transfer electrode 23 is urged against the dielectric sheet 93, similar to the electrodes 21, 22 of FIG. 4. The transfer electrode 23 has the volume resistivity of about $10^{10}$ Ωcm, and the voltage from the electric power source is applied to the tip Y (i.e., an end positioned at a downstream side of the rotating direction of the dielectric sheet 93) of the transfer electrode as shown. Consequently, the voltage applied to the surface of the electrode has a gradient so that the resistance value gradually decreases from the upstream side to the downstream side, with the result that the same technical effect as that of the previous embodiment can be achieved and that the electrode can be more easily manufactured. The electrode 23 may be a uniform resistive body or may be a resistive body having the resistance gradient.

Figure 8:
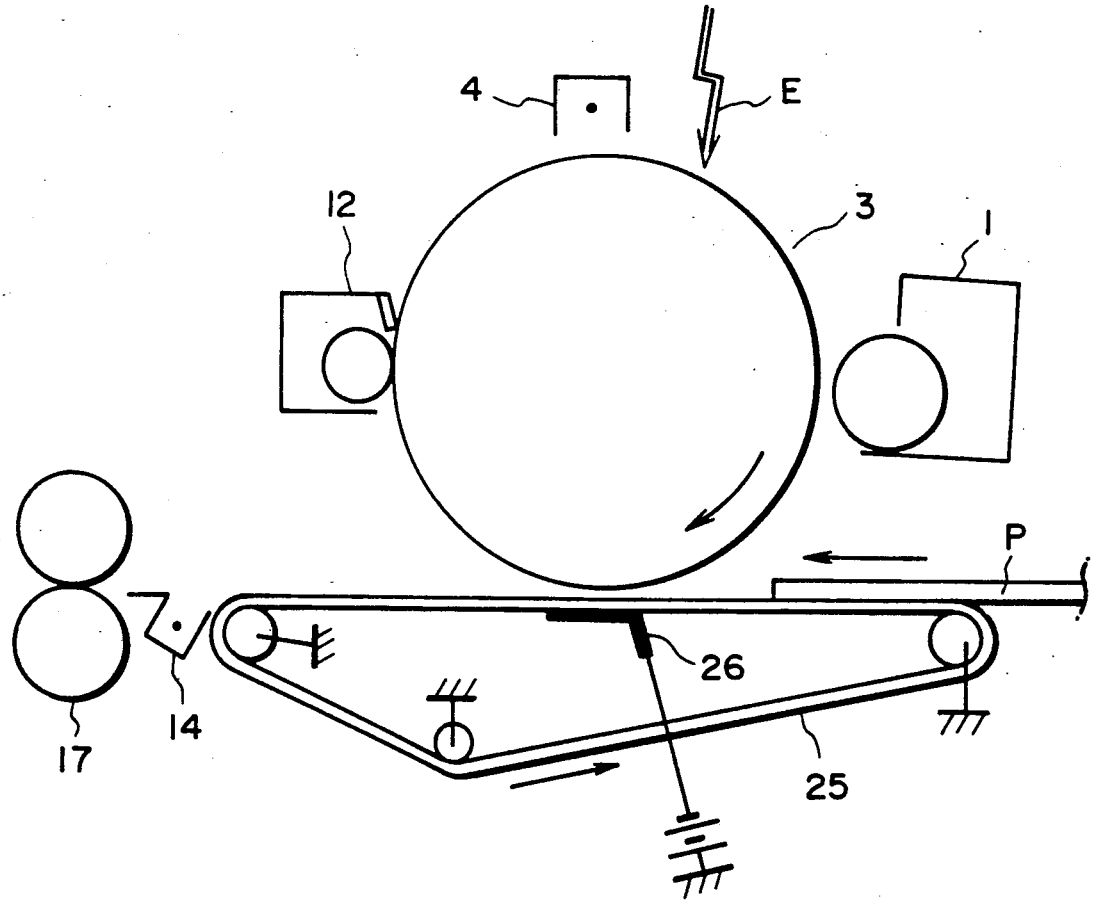
FIG. 8 is a schematic sectional view of an image forming apparatus according to another embodiment of the present invention.

FIG. 8 shows an image forming apparatus according to another embodiment of the present invention. In this embodiment, in place of the transfer drum 9 used in the previous embodiment, a transfer belt 25 is used.

According to this embodiment, the photosensitive drum 3 is uniformly charged by the primary charger 4, and is exposed at the exposure station E, thus forming the latent image on the photosensitive drum. The latent image is visualized by the developing system 1 to form the toner image. On the other hand, the transfer sheet P is fed to the transfer station by means of the tranfer belt 25, and the toner image formed on the photosensitive drum 3 is transferred onto the transfer sheet P by means of a transfer means 26. The transfer sheet P separated from the photosensitive drum 3 is then fed to the fixing device 17, where the image is fixed to the transfer sheet.

In this arrangement, the transfer means 26 may comprise the contact-type transfer electrode as shown in FIGS. 1 and 3 to achieve the same technical effect. Further, when the multi-transfer operation is performed by contacting a plurality of photosensitive drums with the single transfer belt, the same technical effect can be obtained.

As mentioned above, according to the present invention, since the transfer electrode is constituted so that the electric resistance value thereof is greater at the upstream side of the shifting direction of the image bearing member than at the downstream side thereof, it is possible to perform the transfer with low voltage, to make the apparatus small-sized and inexpensive, to prevent the generation of ozone during the transferring operation and to obtain the image with high density and high quality, without any transfer void and the scattering of toner.

What is claimed is:

1. An image forming apparatus comprising:

a shiftable image bearing member;

an image forming means for forming an image on said image bearing member; and a transfer means for transferring the image formed on said image bearing member onto a transfer sheet at a transfer station, said transfer means urging the transfer sheet against said image bearing member and having a transfer electrode to which a voltage is applied; and wherein a resistance value between a surface of said transfer electrode facing said image bearing member and a portion of said transfer electrode at which the voltage is applied is greater at an upstream side of a shift direction of said image bearing member than at a downstream side thereof, on the surface of said transfer electrode.

2. An image forming apparatus according to claim 1, further including a shiftable transfer sheet bearing means for holding the transfer sheet at said transfer station to perform the transferring operation.

3. An image forming apparatus according to claim 2, wherein said transfer sheet bearing means comprises a dielectric sheet.

4. An image forming apparatus according to claim 2, wherein the transfer sheet held by said transfer sheet bearing means is conveyed to said transfer station several times by said transfer sheet bearing means, whereby a plurality of images on the image bearing member are successively transferred onto the transfer sheet in superimposed fashion.

5. An image forming apparatus according to claim 4, wherein a full-color image can be formed after the successive transferring operations in superimposed fashion.

6. An image forming apparatus according to claim 2, wherein said transfer electrode can be contacted with a surface of said transfer sheet bearing means opposite to a surface thereof facing to said image bearing member.

7. An image forming apparatus according to claim 6, wherein a length of contact between said transfer electrode and said transfer sheet bearing means in the shifting direction of said image bearing member is greater than a length of contact between said image bearing member and said transfer sheet bearing means in the shifting direction of said image bearing member.

8. An image forming apparatus according to claim 1, wherein said transfer electrode has volume resistivity which is greater at the upstream side of the shifting direction of said image bearing member than at the downstream side thereof.

9. An image forming apparatus according to claim 1, wherein said transfer electrode has a sheetshaped configuration.

* * * * *

UNITED STATES PATENT AND TRADEMARK OFFICE

CERTIFICATE OF CORRECTION

PATENT NO. : 5,081,501
DATED : January 14, 1992
INVENTOR(S) : Kenichiro Waki, et al.

It is certified that error appears in the above-identified patent and that said Letters Patent is hereby corrected as shown below:

COLUMN 1

Line 14, "electrophotograhic" should read --electrophotographic--;
Line 48, "tern," should read --turn,-- and "affecting" should read --causing--; and
Line 65, "it arose" should read --it caused--.

COLUMN 2

Line 7, "arose" should read --caused--;
Line 15, "abovemen-" should read --above-men- --; and
Line 63, "to" should read --of--.

COLUMN 3

Line 33, "an" should read --a--; and
Line 65, "synchronous" should read --synchronism--.

UNITED STATES PATENT AND TRADEMARK OFFICE

CERTIFICATE OF CORRECTION

PATENT NO. : 5,081,501 Page 2 of 2

DATED : January 14, 1992

INVENTOR(S) : Kenichiro Waki, et al.

It is certified that error appears in the above-identified patent and that said Letters Patent is hereby corrected as shown below:

COLUMN 6

Line 56, "not need" should read --not necessary--; and
Line 57, "chargers," should read --charges,--.

COLUMN 7

Line 4, "(RET)" should read --(PET)--; and
Line 35, "tranfer" should read --transfer--.

COLUMN 8

Line 55, "sheetshaped" should read --sheet-shaped--.

Signed and Sealed this

Eighth Day of June, 1993

*Attest:*

Michael K. Kirk

MICHAEL K. KIRK

*Attesting Officer*

*Acting Commissioner of Patents and Trademarks*